United States Patent [19]

Wigle

[11] Patent Number: 4,856,237

[45] Date of Patent: Aug. 15, 1989

[54] MULTIFUNCTION ROOF EDGER

[76] Inventor: Frank T. Wigle, Ste. 502, Bartlett Bldg. 76 University W., Windsor, Ontario, Canada, N9A 5N7

[21] Appl. No.: 218,811

[22] Filed: Jul. 13, 1988

[51] Int. Cl.[4] ..... E04D 13/06

[52] U.S. Cl. ..... 52/12

[58] Field of Search ..... 52/12, 94, 11

[56] References Cited

U.S. PATENT DOCUMENTS

| | | | |
|---|---|---|---|
| 2,613,621 | 10/1952 | Schraeder | 52/12 |
| 3,248,827 | 5/1966 | Hardy | 52/11 |
| 3,340,657 | 9/1967 | Thomas | 52/11 |
| 3,344,562 | 10/1967 | Miles | 52/11 |
| 3,415,019 | 12/1968 | Andersen | 52/288 |
| 4,594,820 | 6/1986 | Render | 52/94 |
| 4,667,448 | 5/1987 | Smith | 52/12 |
| 4,713,915 | 12/1987 | Sweers | 52/11 |

*Primary Examiner*—John E. Murtagh

*Attorney, Agent, or Firm*—Ralph M. Burton

[57] ABSTRACT

A multifunction roof edger having an inclined mounting portion for mounting and extending inwardly from a roof edge between roof sheathing and shingles to function as a mounting member, as flashing and as a shingle starter; a vertical mounting portion for mounting between an associated eavestrough and a fascia board to function as a mounting member and as flashing; and an overhang portion extending outwardly from a roof edge to function as a drip edge and as a shingle aligning guide. Also provided is an eavestrough screening member that is maintained in position by connectors attached thereto and to an attachment flange depending from the overhang portion.

12 Claims, 1 Drawing Sheet

MULTIFUNCTION ROOF EDGER

TECHNICAL FIELD

This invention relates to combinations of roof drip edges, shingle starters and aligning guides, flashing and eavestrough screens.

BACKGROUND ART

A number of potential problems are typically associated with roofs and roofing. Many result from rain water or melted ice or snow gaining access to building areas under covering shingles, fascia boards, trim pieces, and the like. It is quite common in winter, for example, for eavestroughs to become blocked by ice or other obstructions and for water, having no other drain course available, to find its way under shingles covering roof eaves. It is also common for water running over the actual roof edge to find its way up under shingles. At very least, it wets the fascia board and may find its way behind it.

Once access is gained to roof sheathing or beneath fascia or other trim pieces, water can advance to cause damage in a number of areas within the building, even areas seemingly remote from the leak site. In time, areas repeatedly saturated with water can suffer damage from mildew and rot. If undetected or not repaired, the physical integrity of the structure may eventually be threatened.

Another potential problem is associated with applying shingles to a roof. A starter strip is usually installed along the roof edge before any shingles are affixed. The starter is sometimes formed of a section of rolled roofing material but is often made by trimming the tabs off roofing shingles at the site. Under the pressure of completing a job, the shingles may not be trimmed squarely, allowing small areas of sheathing to be exposed to the weather. Even if the sheathing is completely covered, if the starter material is not applied properly, the subsequently applied shingles aligned therewith may be skewed.

Another common problem involves eavestroughs becoming clogged with objects such as nests, leaves falling from trees; rocks, balls and other toys rolling or washing into the trough after being thrown onto a roof by children; and nuts and twigs rolling or washing into the trough after being dropped onto a roof by squirrels and birds. Guards for eavestrough drains and screens for covering the open tops of eavestroughs are well known in the art, but they each have their own attending problems. Drain guards have a tendency, in time, to corrode and drop into the very drains they were installed to protect, thereby becoming effective clogging elements themselves. Many screens become dislodged and thereafter fail to prevent the passage of undesirable articles into eavestroughs. Some screens can be bent and formed around associated eavestroughs in an attempt to affix them thereto, but installing them is a less-than-precise procedure, and gaps in their coverage commonly result.

DISCLOSURE OF THE INVENTION

An object of the present invention is to provide a multifunction roof edger that will extend inwardly from a roof edge and beneath covering shingles and act as flashing to prevent water that might have reached that area from intruding any farther.

Another object of the present invention is to provide a multifunction roof edger that will extend inwardly from a roof edge to function as a shingle starter.

Yet another object of the present invention is to provide a multifunction roof edger that will extend outwardly from a roof edge to direct water running off the edge away from the fascia board.

Still another object of the present invention is to provide a multifunction roof edger that will extend outwardly from a roof edge and function as a guide for properly aligning a first row of shingles as they are being affixed to the roof.

Another object of the present invention is to provide a multifunction roof edger that is relatively easy and inexpensive to make and to install.

Yet another object of the present invention is to provide a multifunction roof edger that will be readily applicable to roofs having a variety of slopes.

Still another object of the present invention is to provide a multifunction roof edger that will substantially reduce the chance of an associated eavestrough being clogged from the introduction of a foreign object.

Another object of the present invention is to provide a multifunction roof edger that will retain an eavestrough screen in effective position and also facilitate the easy removal thereof for routine eavestrough maintenance.

Yet another object of the present invention is to provide a multifunction roof edger that will be substantially maintenance free and long lasting.

In accordance with the foregoing objects, a multifunction roof edger is provided that functions as a drip edge, a shingle starter, flashing, a shingle aligning guide and a protective eavestrough screen and attachment therefore.

One embodiment of the present invention provides an elongated plastic body having a portion disposed to mount between roof sheathing and shingles to serve as a mounting member, as a shingle starter and as flashing; a portion disposed to mount between a roof fascia board and an associated eavestrough to serve as a mounting member and as flashing; and a portion disposed to overhang the roof edge to serve as a drip edge and as a shingle aligning guide.

Another embodiment of the present invention provides an elongated plastic body having portions disposed to mount between roof sheathing and shingles, to mount between a roof fascia board and an eavestrough, and to overhang the roof edge, all as previously described, the connection between the portion disposed to mount between the roof sheathing and shingles and the portion disposed to mount between the roof fascia board and an eavestrough being flexible to facilitate mounting the body on roofs having a wide variety of slopes.

Still another embodiment of the present invention provides an elongated plastic body having portions disposed to mount between roof sheathing and shingles, to mount between a roof fascia board and an eavestrough, and to overhang the roof edge, all as previously described, and also provides an attachment flange depending from the overhang portion, the attachment flange having a latching member for attaching accessories thereto.

Yet another embodiment of the present invention provides an elongated plastic body having portions disposed to mount between roof sheathing and shingles, to mount between a roof fascia board and an eavestrough, to overhang the roof edge, and to attach accessories thereto, all as previously described, and also provides a removable screening member for allowing the passage of water therethrough while prohibiting the passage of potential eavestrough-clogging objects.

BRIEF DESCRIPTION OF THE DRAWINGS

In the drawings, in which like reference characters indicate corresponding parts in all the views.

DETAILED DESCRIPTION OF PREFERRED EMBODIMENTS OF THE INVENTION

Figure 1:
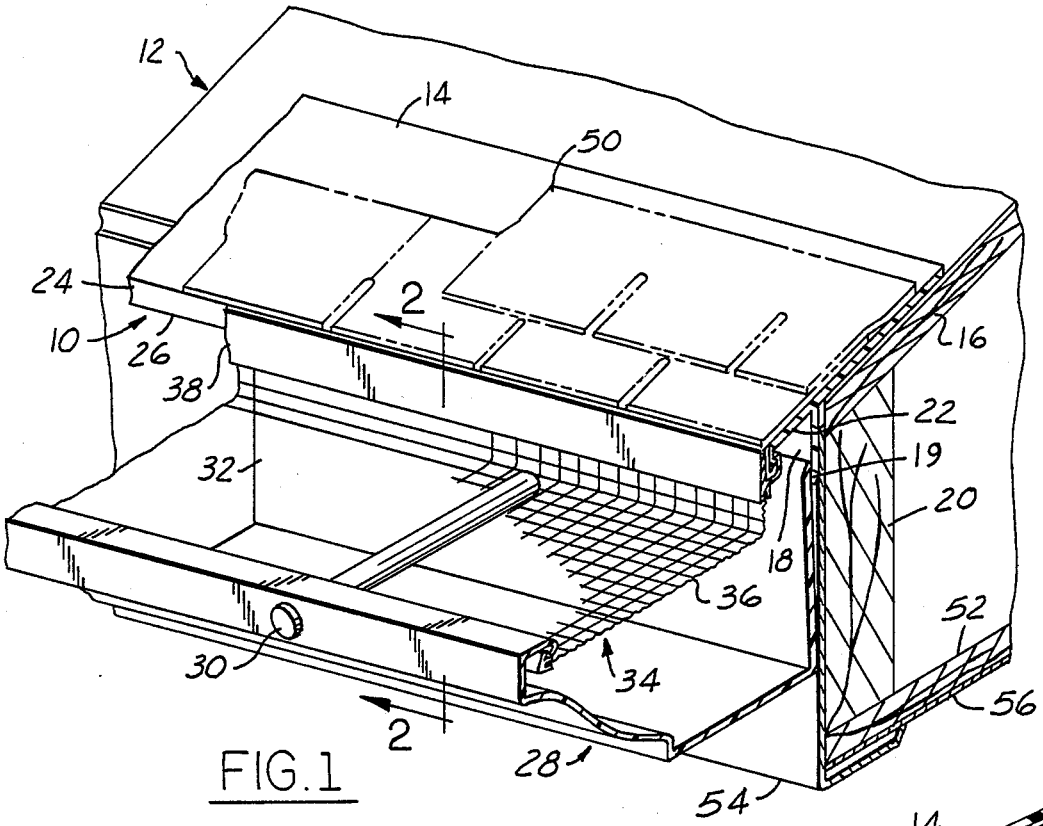
FIG. 1 is a fragmentary, perspective, environmental view of an embodiment of the multifunction roof edger mounted to the eaves of a roof.
Figure 2:
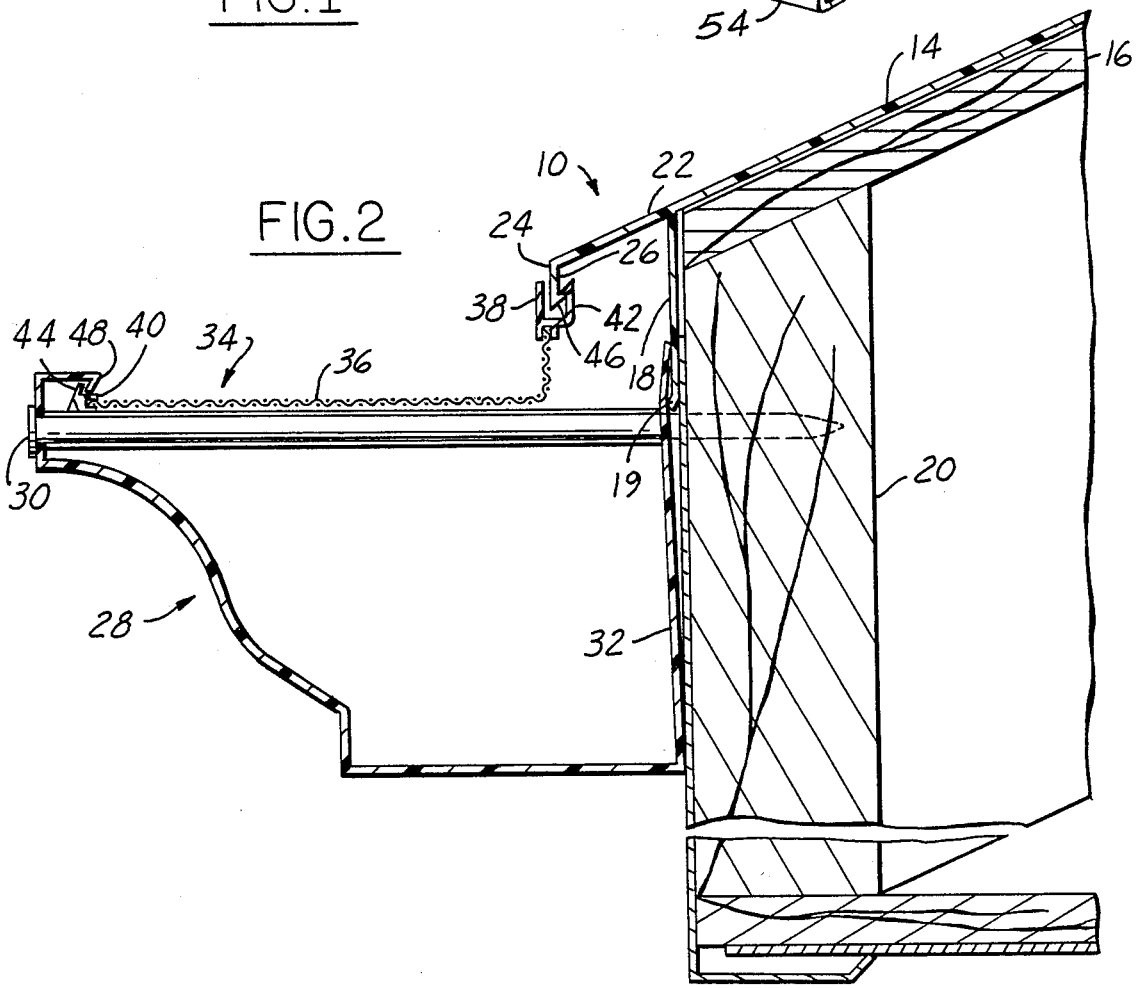
FIG. 2 is a sectional view, taken along line 2—2, of FIG. 1.

With reference to FIG'S. 1 and 2, illustrated is a fragmentary portion of a multifunction roof edger indicated generally by reference numeral 10. The multifunction roof edger 10 is shown as it would be mounted along the eaves of a roof, generally indicated by reference numeral 12, and includes an inclined mounting portion 14 that extends laterally and inwardly with respect to the roof edge. The inclined mounting portion 14 is mounted atop roof sheathing 16 with roofing nails or the like.

The edger 10 also includes a vertical mounting portion 18 that depends from the inclined mounting portion 14 and extends laterally along and downwardly over, and may be mounted to, the surface of a fascia board 20. The vertical mounting portion 18 may be flexibly connected to the inclined mounting portion 14 of the edger 10 so that the angle between the two mounting portions can be readily adjusted to facilitate mounting the edger 10 to roofs 12 having a variety of slopes. The lower margin 19 of the vertical mounting portion 18 may be bent outwardly with respect to the roof fascia plate 20.

Also connected to the inclined mounting portion 14 along the line connecting the vertical mounting portion 18 thereto is an overhang portion 22 extending laterally and outwardly with respect to the roof edge. The inclined mounting portion 14 and the overhang portion 22 may be coplanar. Depending substantially vertically from the outer edge of the overhang portion 22 is an attachment flange 24 having one or more latching members 26 at the lower edge thereof.

As shown in FIG'S. 1 and 2, an eavestrough, indicated generally by reference numeral 28, may be fastened to the fascia board 20 with nails 30 or other commonly used fasteners. As shown, the lower margin 19 of the vertical mounting portion 18 is disposed between the fascia board 20 and the rear portion 32 of the eavestrough 28, the rear portion 32 and the vertical mounting portion 18 being secured to the fascia board 20 with nails 30.

Shown as it would be typically mounted atop an eavestrough 28 is a screening member, indicated generally by reference numeral 34, having a perforated or reticular portion 36, at least one inner connector 38 and one outer connector 40 formed respectively along the edges of the screening member 34 nearest to and farthest from the fascia board 20. As shown, the inner connector 38 may be in the form of an elongated spring snap 42, and the outer connector in the form of an elongated spring pawl 44.

Along the lower edge of the latching member 26 is formed at least one pawl 46, which, as shown, may be formed along a substantial portion of the edge of the latching member 26. The inner connector 38 is releasably engageable with the pawl 46, and the outer connector 40 is releasably engageable with the outer lip 48 of the eavestrough 28.

As shown in FIG. 1, the inclined mounting portion 14 of the multifunction roof edger 10 extends laterally and inwardly with respect to the edge of the roof 12 and, in doing so, covers a portion of the sheathing 16. The inclined mounting portion 14 is mounted atop the sheathing 16 and below roofing materials, such as shingles 50. In this position, the inclined mounting portion 14 functions as flashing and thereby prevent any water that might have intruded under the shingles 50 from gaining access to the sheathing 16 or any area thereunder. In this position, the inclined mounting portion 14 also functions as a shingle starter strip, thereby saving the material and time required to prepare and install a separate starter strip.

The vertical mounting portion 18 extends downwardly from the inclined mounting portion 14 and, in doing so, covers a portion of the fascia board 20. The vertical mounting portion 18 is mounted behind the rear portion 32 of an associated eavestrough 28, allowing the eavestrough 28 to be mounted higher than is possible with some roof edge devices; and the outwardly bent lower margin 19 of the vertical mounting portion 18 forms a water-excluding juncture with the rear portion 32 of the eavestrough 28, thereby preventing the intrusion of any water therebeneath.

The overhang portion 22 of the multipurpose roof edger 10 extends laterally and outwardly with respect to the edge of the roof 12 and, in doing so, forms an overhanging drip edge to prevent water draining from the roof away from the roof fascia board 20. The edge of the overhang portion 22 also forms a guide for aligning a first row of shingles.

FIG'S. 1 and 2 show, as is increasingly common, the fascia board 20 and an associated soffit 52 clad with a protective covering, 54 and 56 respectively, which may be formed of such materials as aluminum, vinyl or the like. As shown, the multifunction roof edger may be affixed over this material.

Many changes and modifications may be made to the details of the described multipurpose roof edger without departing from the nature and spirit of the invention. Accordingly, it is to be understood that the invention is not limited to those details but is defined by the appended claims.

What is claimed is:

1. A multifunction roof edger comprising:

an inclined mounting portion for mounting fixedly atop roof sheathing and being longitudinally coextensive with a roof edge, said inclined mounting portion extending laterally and inwardly with respect thereto, said inclined mounting portion thereby also functioning both as flashing and as a shingle starter;

a vertical mounting portion for mounting fixedly to a roof fascia board, said vertical mounting portion depending from said inclined mounting portion along a line closely paralleling the roof edge and being disposed obtusely with respect to said inclined mounting portion, said vertical mounting portion thereby also functioning as flashing;

an overhang portion connected to said inclined mounting portion and to said vertical mounting portion along the line of intersection therebetween and extending laterally and outwardly with respect to the roof edge to form an overhanging drip edge to keep water draining from the roof away from the roof fascia board, the outermost edge of said overhang portion functioning also as a shingle aligning guide;

an attachment flange connected to and depending substantially vertically from the outer edge of said overhang portion, said attachment flange having at least one latching member for attaching accessories thereto; and an elongated screening member for mounting atop an associated eavestrough said screening member having a reticular or perforated portion for allowing the passage of water therethrough while prohibiting the passage of objects that might clog the eavestrough, said screening member having, along the edge thereof nearest to the fascia board, at least one inner connector removably connectable to said latching member of said attachment flange, and said screening member having, along the edge thereof farthest from the fascia board, at least one outer connector removably connectable to the outer lip of the eavestrough.

2. A multifunction roof edger according to claim 1, wherein said vertical mounting portion is flexibly connected to said inclined mounting portion such that said inclined mounting portion can be positioned closely parallel to roofs having a wide variety of slopes.

3. A multifunction roof edger according to claim 1, wherein said overhang portion is substantially coplanar with respect to said inclined mounting portion.

4. A multifunction roof edger according to claim 1, wherein said inclined mounting portion mounts between the roof sheathing and shingles affixed thereupon, thereby isolating the sheathing from water backing up under the shingles from an associated plugged or overfilled eavestrough.

5. A multifunction roof edger according to claim 1, wherein said vertical mounting portion mounts between a fascia board and an associated eavestrough, thereby permitting the eavestrough to be mounted higher than usual and also preventing water from contacting the fascia board.

6. A multifunction roof edger according to claim 1, wherein the lower margin of said vertical mounting portion is bent outwardly with respect to the roof fascia board to form a water-excluding juncture with the back portion of an eavestrough mounted thereto.

7. A multifunction roof edger according to claim 1, wherein said body comprises a high-density, all-weather, waterproof, heat-resistant, fire-retarding vinyl plastic that is relatively impervious to ultraviolet light.

8. A multifunction roof edger according to claim 1, wherein said attachment flange lathcing member includes a pawl and said inner connector includes a spring snap releasably engageable with said pawl.

9. A multifunction roof edger according to claim 1, wherein said latching member extends along a substantial portion of said attachment flange and forms an elongated pawl along a substantial portion of the lower edge thereof, said pawl being releasably engagable with said spring snap.

10. A multifunction roof edger according to claim 1, wherein said outer connector includes at least one spring pawl engageable with the outer lip of an associated eavestrough.

11. A multifunction roof edger according to claim 1, wherein said screening member is bounded along a substantial portion of the edge thereof nearest to the fascia board by a strip forming an elongated spring snap along a substantial portion of the length of the strip, said spring snap being releasably engageable with said pawl.

12. A multifunction roof edger according to claim 1, wherein said screening member is bounded along a substantial portion of the edge thereof farthest from the fascia board by a strip forming an elongated spring pawl along a substantial portion of the length of the strip, said spring pawl releasably engageably with the outer lip of an associated eavestrough.

* * * * *